US005311159A

United States Patent [19]

Miura et al.

[11] Patent Number: 5,311,159

[45] Date of Patent: May 10, 1994

[54] BANDPASS TYPE FILTER HAVING TRI-PLATE LINE RESONATORS

[75] Inventors: Taro Miura, Tokyo; Tadao Fujii; Shinya Nakai, both of Chiba, all of Japan

[73] Assignee: TDK Corporation, Tokyo, Japan

[21] Appl. No.: 847,012

[22] PCT Filed: Sep. 9, 1991

[86] PCT No.: PCT/JP91/01198

§ 371 Date: Jan. 8, 1993

§ 102(e) Date: Jan. 8, 1993

[87] PCT Pub. No.: WO92/04741

PCT Pub. Date: Mar. 19, 1992

[30] Foreign Application Priority Data

Sep. 10, 1990 [JP] Japan ..... 2-237041
Apr. 12, 1991 [JP] Japan ..... 3-106355
Jun. 17, 1991 [JP] Japan ..... 3-170363

[51] Int. Cl.[5] ..... H01P 1/203

[52] U.S. Cl. ..... 333/204; 333/205; 333/238

[58] Field of Search ..... 333/203, 204, 205, 219, 333/238, 246, 235

[56] References Cited

U.S. PATENT DOCUMENTS 3,135,935 6/1964 Engelbrecht ..... 333/238
4,801,905 1/1989 Becker ..... 333/238
4,916,417 4/1990 Ishikawa et al. ..... 333/204

FOREIGN PATENT DOCUMENTS 58-94202 6/1983 Japan .
0117701 7/1983 Japan .
58-166803 10/1983 Japan .
0051606 3/1984 Japan .
0117802 7/1984 Japan .
60-53302 3/1985 Japan .
60-124104 8/1985 Japan .
0018301 1/1989 Japan .
0297901 12/1989 Japan ..... 333/204
0123790 5/1990 Japan .
2-106701 8/1990 Japan .

OTHER PUBLICATIONS

Matsunaga et al., "Electromagnetic Coupling Between Two-layered Microstrip lines", Mitsubishi Elec. Corp. Sep. 15, 1990, p. 2-397.

*Primary Examiner*—Seungsook Ham
*Attorney, Agent, or Firm*—Nikaido, Marmelstein, Murray & Oram

[57] ABSTRACT

A tri-plate line is constructed from a resonance element formed by intervening dielectrics between one pair of ground conductors (6). The length of the line is adjusted to about ¼ wave-length. Then, a bandpass filter is formed by combining a plurality of resonators (5) of which one end is grounded. Each of the resonators (5) is separated by separators (9) so that waveguide mode propagation in the tri-plate line is prevented from occurring. A plurality of the tri-plate lines are piled up. The electromagnetic coupling of the resonators in different layers with each other are conducted by means of coupling means (7) formed in the dielectric and the ground conductor. The resonators disposed at both ends are coupled with input/output terminals (1,2), respectively.

34 Claims, 8 Drawing Sheets

Fig. 7(a)
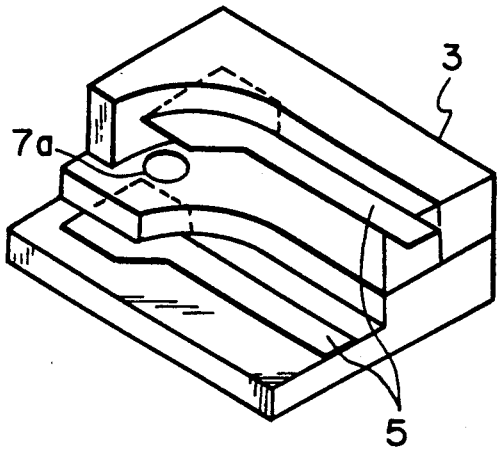
Fig. 7(b)
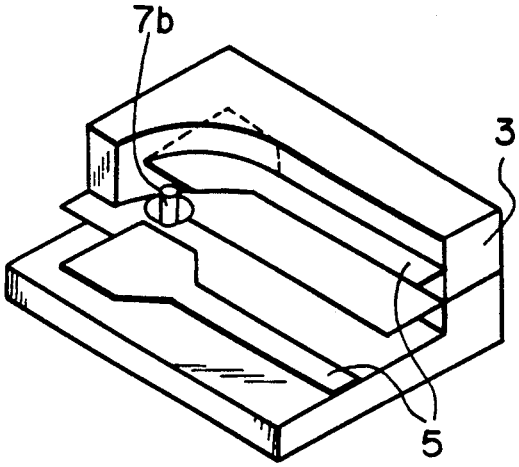
Fig. 7(c)
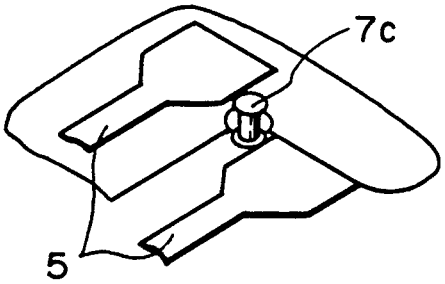
Fig. 7(d)
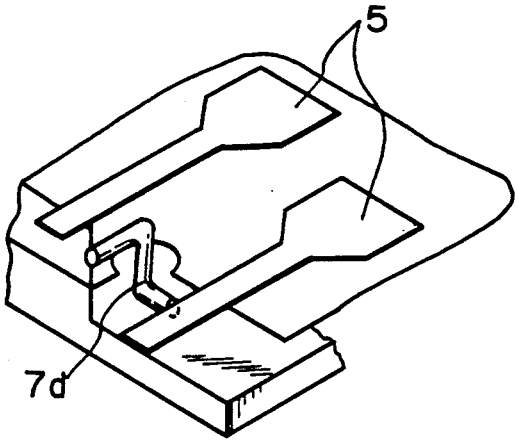
Fig. 8(a)
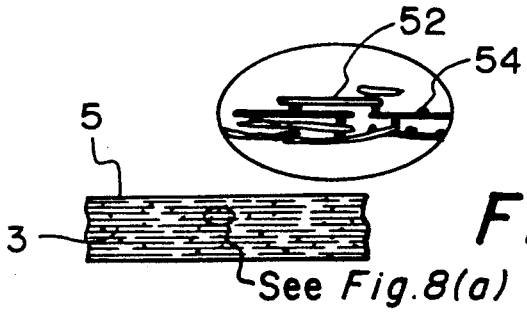
Fig. 8

BANDPASS TYPE FILTER HAVING TRI-PLATE LINE RESONATORS

TECHNICAL FIELD

Field of the Invention

The present invention relates to a bandpass type filter, particularly to a bandpass type filter using resonators constituted by tri-plate lines.

Background of the Invention

A conventional bandpass type filter using a dielectric substrate is constituted by sequentially coupling a plurality of resonators and has predetermined bandpass characteristics around resonance frequencies thereof. In these resonators, many resonance modes (excitation modes) appear dependent on the shape and dimensions of the element. Basic resonance modes used in general are a $TE_{018}$ mode $TE_{018}$ resonator), a $TM_{010}$ mode ($TM_{010}$ resonator), and a TEM mode (TEM resonator). If the resonance frequency is the same in these modes, the sizes of the resonance systems become smaller in the order through the $TE_{018}$ mode, the $TM_{010}$ mode, and the TEM mode, whereas the values of unload Q also become smaller in the same order. For a filter used in a mobile communication device, since loco weight and a small size are required characteristics, the TEM mode resonator is utilized. Particularly, a coaxial TEM resonator of $\frac{1}{4}\lambda$ mode is frequently used.

FIGS. 9 (*a*) to 9 (*c*) are views showing structure of conventional bandpass type filters using TEM resonators. FIG. 9 (*a*) shows a filter using coaxial line type dielectric resonators. In the filter, coaxial line type resonators (TEM resonators 102) are separately constructed and are sequentially coupled in a metallic case 101. Furthermore, input/output terminals and coupling circuit (not shown) are constructed in a metallic lid 103. FIG. 9 (*b*) shows a structure for a general TEM resonator filter. This TEM resonator filter is a type recently most widely used, and in which input/output terminals (input/output coupling electrodes 105), TEM resonators 106, and coupling circuits 107 are integrally constructed in one dielectric block 104. In order to separate each of the resonators, slits 108 for electric separation of adjacent resonators are inserted between the resonators. Reference number 109 denotes a ground conductor electrode.

FIG. 9 (*c*) shows structure of a microstrip line type filter. This filter is constituted by a ground conductor 110, a dielectric 111, input/output terminals 112, TEM resonators 113, and coupling circuits 114.

One application of such a filter may be an antenna duplexer. The antenna duplexer is an antenna sharing device in which a receiving filter with respect to the receiving frequency of a weak signal inputted from a common antenna, and a transmitting filter with respect to the transmitting frequency of a power signal outputted to the antenna are coupled with one terminal which is connected to the shared antenna. This antenna duplexer is one of important components of a bidirectional communication system which may be represented by a mobile telephone system. The antenna duplexer can be apparently seen as a combination of two filters, and matching of the shared terminal of the filters has been already done during the design stage of the filters, so that a manufacturer of the duplexer need not execute the matching.

With miniaturization of communication devices, the manufacturers of such devices have been strongly requested to miniaturize the filter more and more, and are also requested to mount elements of the filter on a single plane. In order to realize further miniaturization of the filter without spoiling the electrical characteristics thereof, it is necessary to develop a new dielectric material. Furthermore, many recent communication devices have been used in higher frequencies. One example thereof is that demand for filters operable in a frequency band more than about 1.5 GHz has increased. The 1.5 GHz band corresponds to the frequency band for data communication using satellites e.g., filters used in a mobile navigation system (1.6 GHz band) or in satellite communication (1.5 GHz).

PROBLEM TO BE SOLVED BY THE INVENTION

However, the bandpass filters with the above-mentioned structure, particularly in case of the filters of FIGS. 9 (*a*) and (*b*), have a problem in that further miniaturizaion for responding to the recent demand is difficult owing to their structure, namely because the separated resonators are sequentially coupled The microstrip line resonator of FIG. 9 (*c*) can be miniaturized because a resonance wave-length $\lambda_g$ will be reduced by using material with a large specific dielectric constant $\epsilon_r$ for a substrate thereof However, this resonator has a problem in that the unload Q thereof will be decreased owing to great conductive losses and great radiation losses, and thus performance of its filter will be lowered.

It is an object of the present invention to solve the above-mentioned problems of the conventional art and to provide a bandpass type filter which can be miniaturized without compromising the electrical characteristics thereof.

SUMMARY OF THE INVENTION

One feature of the present invention is to provide a bandpass type filter having a piled structure of a plurality of unit lamination structures each of which is constituted by a first dielectric substrate provided with a bottom face on which a first ground conductor is attached by a circuit pattern face attached on the first dielectric substrate, and by a second dielectric substrate closely contacted to the first dielectric substrate via the circuit pattern face and provided with a top face on which a second ground conductor is attached. The circuit pattern face has at least one resonance element formed at a predetermined interval so that the resonance element is commonly grounded at one end of the resonance element. The filter has a coupling means for electromagnetically coupling two resonance elements disposed in different unit lamination structures, the means being formed in the dielectric substrate between the two resonance elements. A separator is used for electromagnetically separating the resonance elements on each of the unit lamination structures, while first and second input/output terminals are coupled with the resonance elements disposed in end portions, the terminals being capable of coupling with an external circuit.

In the above-constitution, it is one feature of the present invention that the resonator is formed by a tri-plate line between a pair of the ground conductors through dielectric plates.

Also it is another feature of the present invention that a plurality of the tri-plate lines are piled up and the electromagnetic coupling of the resonators in different layers with each other are conducted by means of the coupling means.

Furthermore, it is a feature of the present invention that the resonators on the same plane are electromagnetically separated by separators so that waveguide mode propagation in the tri-plate line is prevented.

BRIEF DESCRIPTION OF THE DRAWINGS

FIGS. 7(*a*)–7(*d*) are views showing several embodiments of a coupling hole;

FIG. 8 is a view showing a structure of a inner conductor; and

DETAILED DESCRIPTION OF THE PREFERRED EMBODIMENTS

Figure 1A:
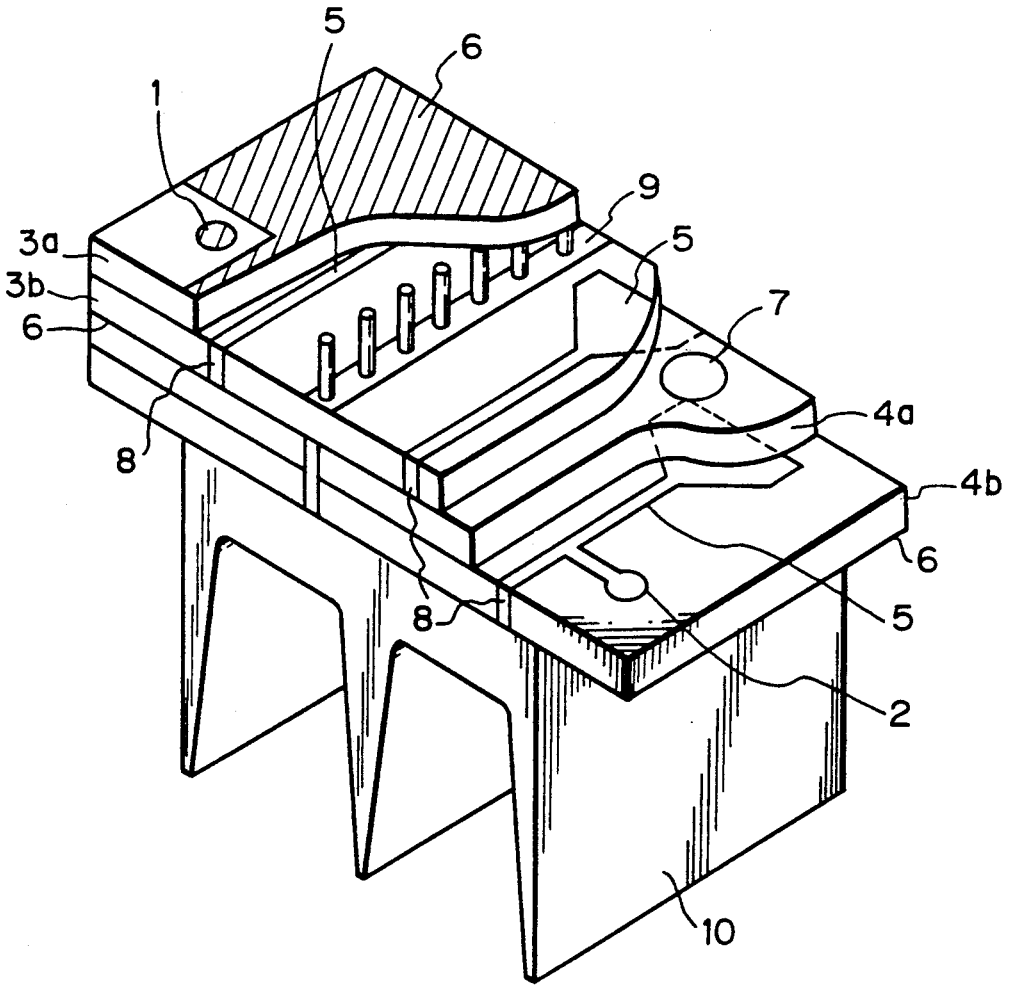
FIG. 1A is a partially sectional view in perspective of a bandpass type filter according to the present invention.
Figure 1B:
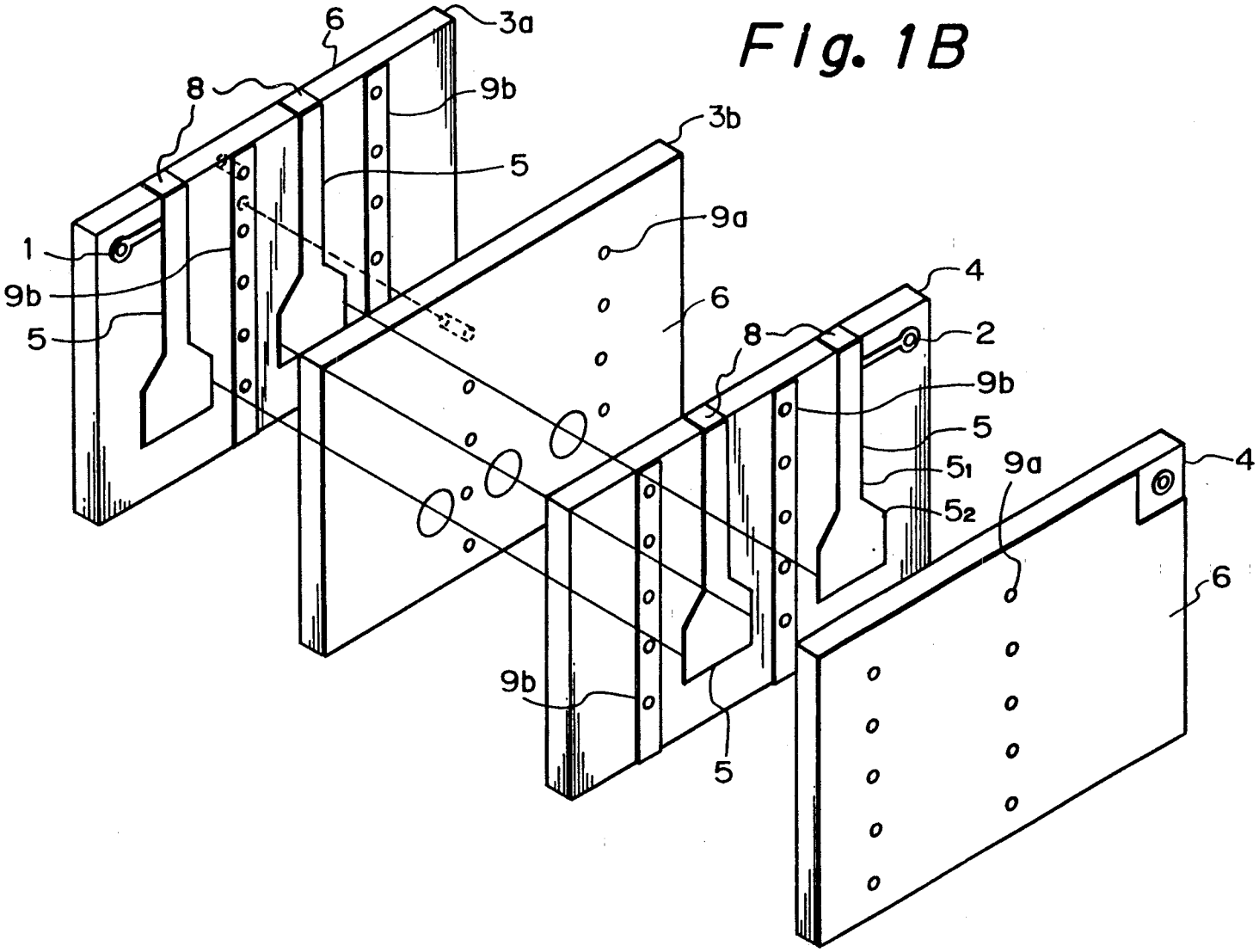
FIG. 1B. is an exploded perspective view of a bandpass type filter according to the present.
Figure 1C:
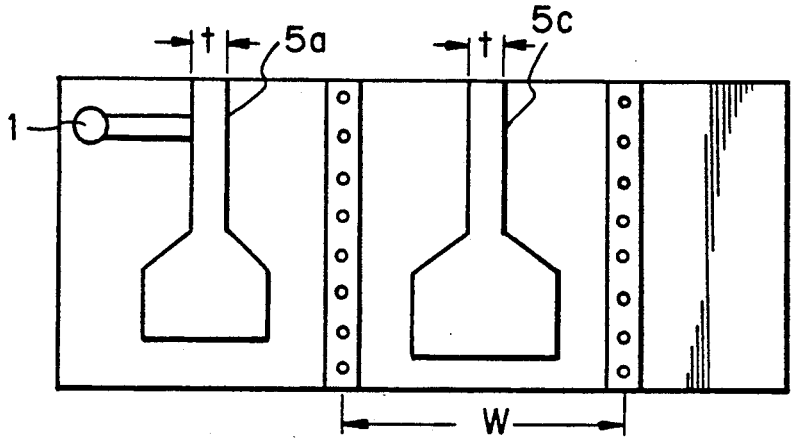
FIGS. 1C(*a*)–1C(*c*)are pattern views and a sectional view of a bandpass type filter according to the present invention.
Figure 1C:
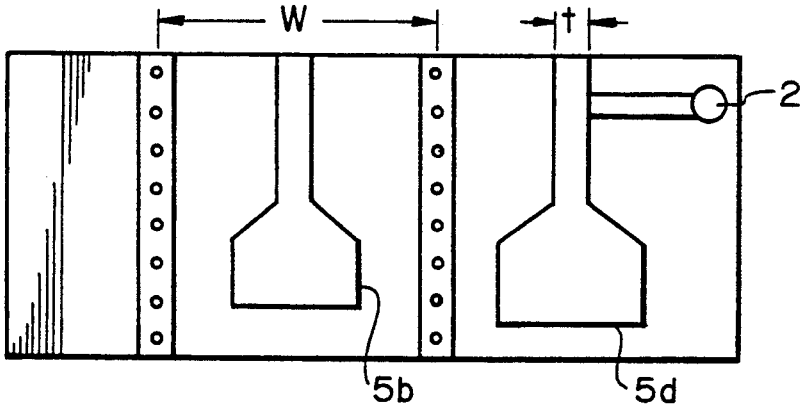
Figure 1C:
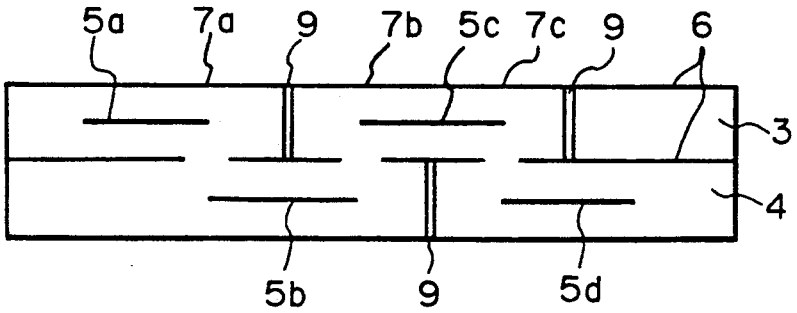

FIG. 1A shows a bandpass type filter according to the present invention by partially sectioned, FIG. 1B shows the filter by exploding it into each of the dielectric layers, and FIGS. 1C(*a*)–1C(*e*) show conductor patterns of respective layers and a section of the filter. This embodiment shows a four-resonator filter in which each layer has two resonators by piling two tri-plate lines up.

In these figures, 1 and 2 denote input/output terminals, 3 (3*a*, 3*b*) and 4 (4*a*,4*b*) denotes dielectric substrates, 5 denote resonance circuits, 6 denotes ground conductors (shield plates), 7 denotes a coupling hole formed by eliminating the ground conductors 6 so as to electrically couple the upper resonance circuit with the lower resonance circuit, 8 denotes end portions of the resonance circuits 5, for connecting the circuits with the ground conductors 6 via conductive strips provided on the side surface of the dielectric substrates or through-holes (not shown), 9 denotes separators (which constitute short circuits) connected to the ground conductors 6 for suppressing the generation of waveguide mode propagation, and 10 denotes a heat radiator for decreasing the insertion loss of the filter In the above-mentioned structure, the ground conductors 6 are formed on the whole of one face of the dielectrics 3*a* and 3*b*, respectively, and lines constituting the resonance circuits 5 are formed on the other face of the dielectric 3*a*. A tri-plate line is constructed from one pair of the ground conductors 6 and from the conductor lines formed by intervening the dielectrics 3*a* and 3*b* between the ground conductors 6. Thus, by adjusting the length of the conductor line to about ¼ wave-length, a tri-plate resonator can be obtained.

Each of the inner conductors 5 with a length approximately equal to ¼ wave-length has a slender first part $5_1$ and a second part $5_2$ wider than the first part. An end portion of the first part 5 is connected to the ground conductor 6.

The structure of tri-plate lines using the dielectrics 4*a* and 4*b* is the same as the aforementioned structure of the tri-plate lines using the dielectrics 3*a* and 3*b*. In case that two tri-plate lines are to be piled up, it is possible to use only one intermediate ground conductor which will be common to the two tri-plate lines.

In order to electromagnetically couple resonators in different layers with each other, the coupling means 7 are formed in the dielectric 3*b* and the ground conductor which covers the dielectric 3*b*. The coupling means 7 are formed at positions close to edges of the wide parts $5_2$ of the inner conductors 5, respectively. The inner conductors 5*a*, 5*b*, 5*c*, and 5*d* in respective layers are disposed so that an edge of the each conductor is close to an edge of the neighbor conductor as shown in FIG. 1C-(*c*), and the coupling means are close to respective edges of the two adjacent internal conductors.

Thus, electromagnetic wave applied to the input terminal 1 is outputted to the output terminal 2 via the resonators 5*a*, 5*b*, 5*c*, and 5*d* shown in FIG. 1C-(*c*).

The upper and lower ground conductors 6 holding the resonance element 5 between them are electrically short-circuited with each other by means of the separators 9 disposed at an interval equal to or less than half a wave-length (λ/2) of the operational frequency, so that the resonance elements 5 in the same layer are prevented from coupling with each other by waveguide mode propagation. The ground conductors 6 also prevent the resonance circuits 5 from being coupled with each other between the layers.

A coupling between the resonance elements 5, which is necessary for constituting a bandpass type filter is realized through a coupling between the layers. The resonance elements 5 are never coupled in the same layer. Namely, the coupling between the different layers is realized by forming appropriate coupling holes 7 through the ground conductors 6 so that the resonance circuits in the respective layers are electrically or magnetically coupled with each other (in FIGS. 1, the upper and lower resonance circuits are coupled by electric field coupling). A coupling between the present bandpass type filter and an external circuit is realized by directly connecting the external circuit with the resonance circuit, or by electrically or magnetically connecting the external circuit with the resonance circuit via an antenna (not shown).

In the aforementioned embodiment, the resonance circuit is constituted by a tri-plate line. However, this resonance circuit is not restricted to the tri-plate line but may be constituted by a two-dimensional circuit such as a slot line or coplanar line, or by hybrid thereof. Furthermore, it may be constructed by a discrete concentrated constant circuit in which an inductance and a capacitance can be apparently separated, or a distributed constant circuit in which these cannot be apparently separated.

Hereinafter, an another embodiment of the resonance circuit structure will be described.

In a concentrated constant type resonance circuit constituted by a tri-plate line, since current concentrates at the side edge portions of the line, there occurs resistance loss in the conductor and thus the Q value of the inductance portion does not reach a required value causing the insertion loss of the filter to increase. In order to decrease the resistance loss, the line corresponding to the inductance portion (narrow width section for a resonance element) is divided along a longitudinal direction of the current flowing so as to reduce the current density. Each of the ends of the divided lines are commonly connected with the capacitance portion, and then the inductance portions are driven in-phase. This example is shown as 5M in FIG. 2. Another example shown as 5N in FIG. 3, has the conductor divided into upper and lower conductors connected with each other so as to reduce the current density.

Figure 2:
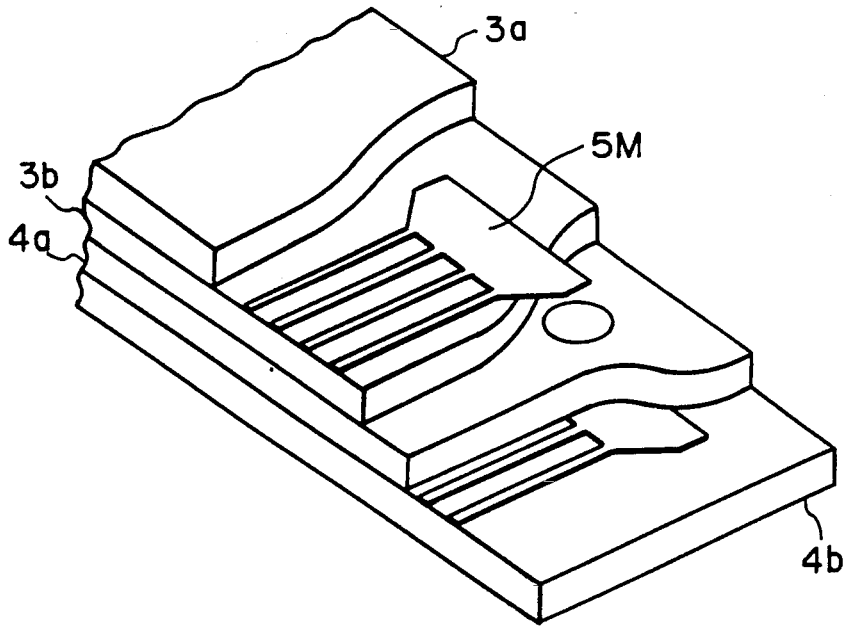
FIG. 2 shows a modification of a bandpass type filter according to the present invention.
Figure 3:
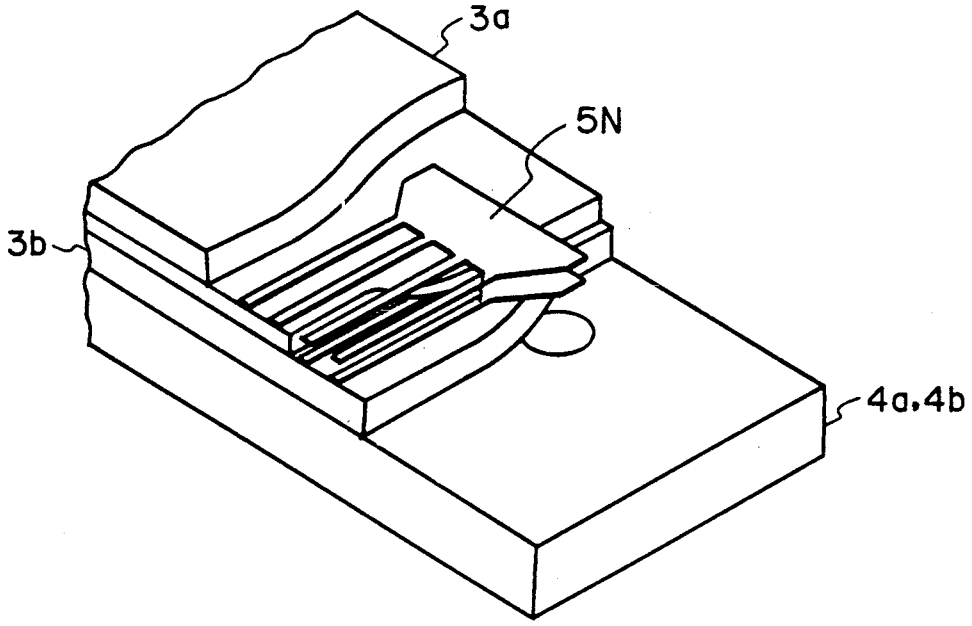
FIG. 3 shows another modification of a bandpass type filter according to the present invention.

These structures of the resonance circuits shown in FIGS. 2 and 3 are advantageous for increasing the Q value of the concentrated constant type resonance circuit using tri-plate lines and/or strip lines.

The above-mentioned bandpass type filter, which is constituted by a tri-plate type strip line, is electromagnetically equivalent to a coaxial type resonator. Therefore, the Q value thereof will be the same as that of a conventional TEM dielectric resonator. Also as the dielectric substrate is formed in a piled structure, further miniaturization of the filter can be attained in comparison with a coaxial dielectric bandpass type filter. Thus, the present bandpass type filter may be utilized in a device such as an antenna duplexer which introduces miniaturization of a device.

Figure 4:
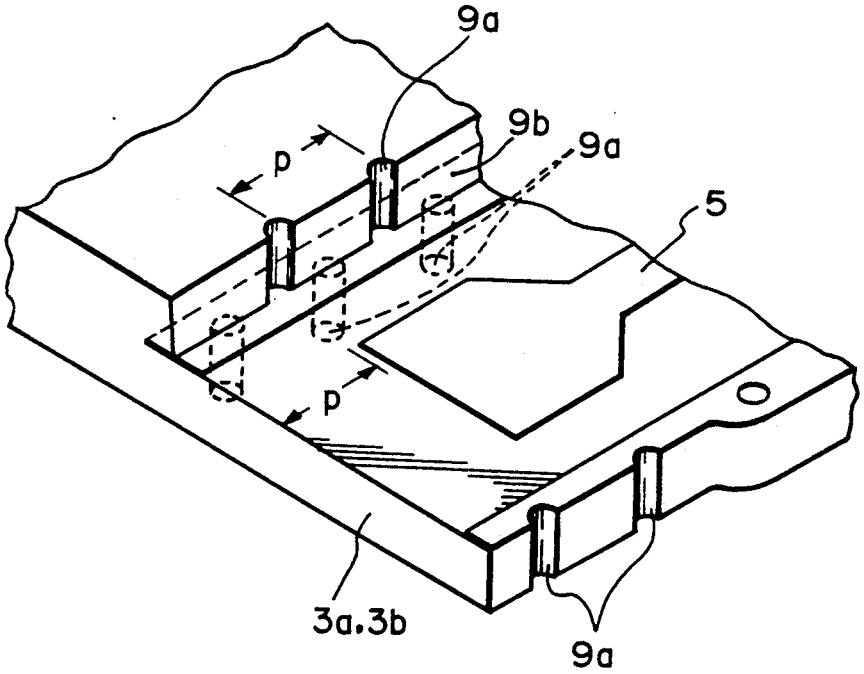
FIG. 4 is an enlarged view of a separator portion.

Although, in the above embodiment, the filter has been illustrated as having a structure with four resonators, the filter of the present invention is not limited to this number of stages. It is apparent that the embodiment can be modified by appropriately modifying the number of the resonators so as to obtain desired bandpass characteristics. Referring to FIG. 4, the separators 9 will now be illustrated. As is described, the resonator according to the present invention operates in the TEM mode. However, in the tri-plate line, it is necessary for suppressing a waveguide mode propagation which will occur regarding a pair of the ground conductors as walls of a waveguide. To this end, the tri-plate line is electrically separated by the separator so that the width of the line is reduced to equal to or less than a wavelength of the cut off frequency of the waveguide mode propagation.

Each of the separators 9 has a plurality of conductive poles 9*a* substantially aligned, and each of the poles 9*a* electrically short-circuits the ground conductors disposed on both sides of the internal conductor 5 with each other. In fact, each of the poles 9*a* is formed by printing conductive material on inner faces of respective holes formed through the dielectric.

The interval W of the separators 9 (FIGS. 1C) is equal to or less than the cut off wave-length in the waveguide mode propagation. This interval will in fact be determined to a value such that a $TE_{01}$ mode propagation does not occur.

The cutoff wave-length in the $TE_{01}$ mode propagation is half of the wave-length $\lambda_g$ of a wave propagating in the dielectric.

If the value W is too small, the propagation of the TEM mode will be influenced.

In the TEM mode, 99% of the electromagnetic energy will be contained within a region which has a width at most five times the width (t) of the internal conductor Therefore, the interval W of the separators 9 has to satisfy the following equation.

$$0.5\,\lambda_g > W > 5t \qquad (1)$$

It should be noted that there is the following relationship between the wave-length $\lambda_0$ in vacuum and the wave-length $\lambda_g$ in the dielectric.

$$\lambda_g = \lambda_0/\sqrt{\epsilon}$$

Also, a pitch p of the poles 9*a* has to be equal to or less than the cut off wave-length in the waveguide mode propagation so that electromagnetic waves will not leak through spaces between the poles. For suppressing the waveguide mode only, it is sufficient that the maximum interval between the adjacent poles disposed in the same substrate is equal to or less than the cutoff wave-length. However, if a length of a transmission pass (in this case, this is a diameter d of the poles) is short, since leakage of electromagnetic field is not negligible, the pitch of the poles should be narrowed to suppress the leak causing the mutual interference of adjacent resonators on the same plane to reduce. From experiments,it has been confirmed that the condition of a following equation (2) should be satisfied.

$$p \leqq 0.2\,\lambda_g \quad \text{where } d \leqq \lambda_g \qquad (2)$$

If a length of the poles 9*a* is long, each of the poles constituted by printing conductive material on inner faces of the through holes may not electrically short-circuit the upper and lower ground conductors. To solve this problem, strip shaped junction electrodes 9*b* positioned in parallel with the ground conductor 6 in the same plane as that of the internal conductors 5 are formed. The poles 9*a* connected to each of the junction electrodes 9*b* extend from the junction electrode 9*b* toward the upper and lower ground conductors, alternately. As a result, the length of the poles 9*a* can be shortened to ensure the electrical connection between the upper and lower ground conductors.

Figure 5A:
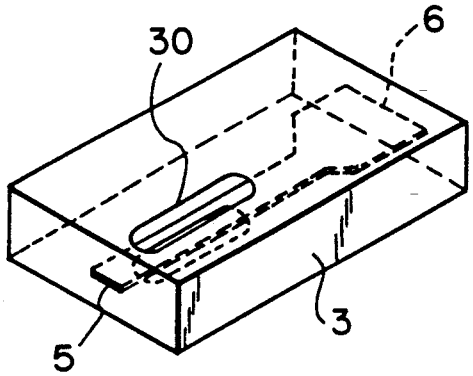
FIGS. 5(*a*) and 5(*b*) are views showing a slit for trimming a resonance element.
Figure 5B:
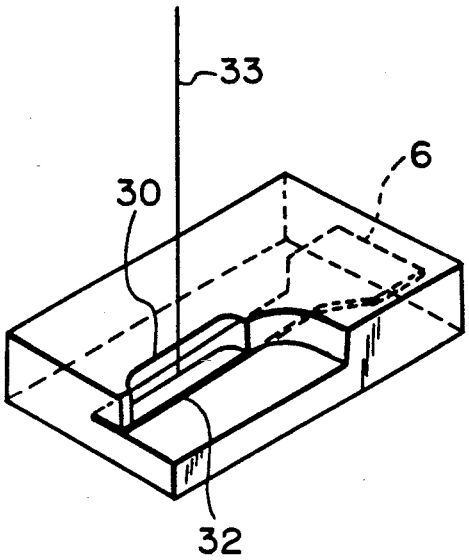
Figure 6:
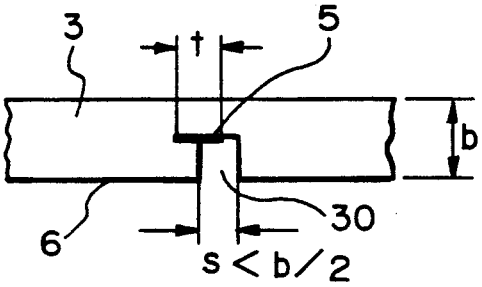
FIG. 6 is a sectional view of the slit showing in FIGS. 5(*a*) and 5(*b*)
Figure 9:
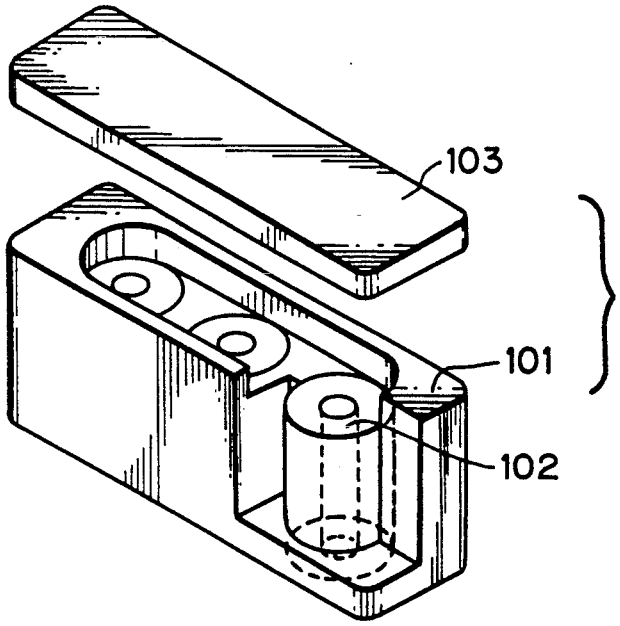
Fig. 9 (a) PRIOR ART
FIGS. 9(*a*)–9(*c*) are views showing structures of conventional filters.
Figure 9:
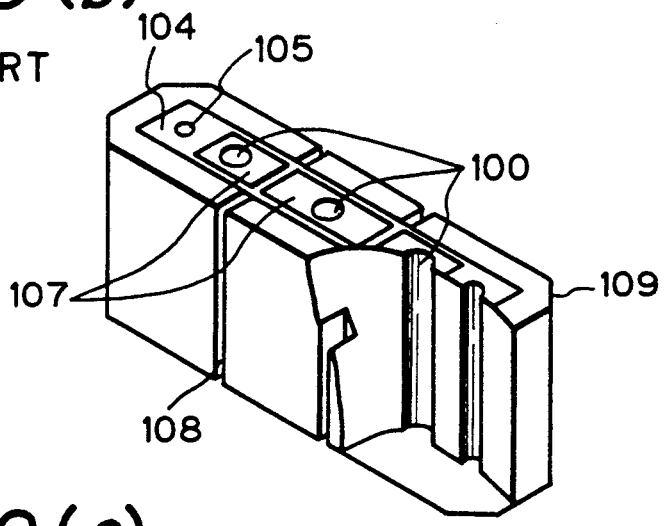
Fig. 9 (b) PRIOR ART
Figure 9:
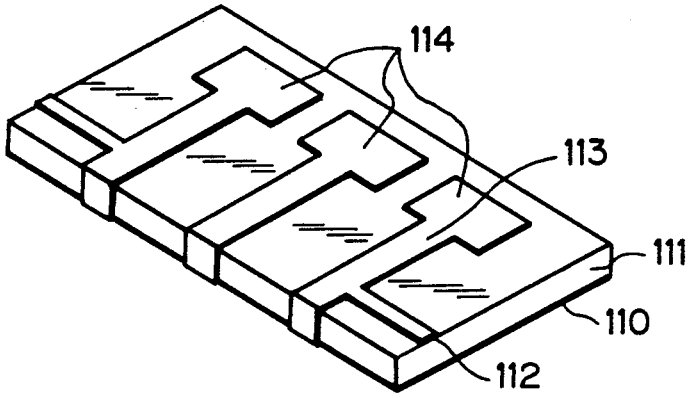
Fig. 9 (c) PRIOR ART

Now, adjustment of a resonance frequency of the resonator will be described with reference to FIGS. 5 and 6.

For performing fine adjustment of the resonance frequency, according to the present invention, the resonance element 5 is trimmed by means of a laser beam. If the inductance section (the narrow width part $5_1$) of the resonance element is trimmed to be narrower, the resonance frequency is decreased. Contrary to this, if the capacitance part (the wide width section $5_2$) is trimmed to be narrower, the resonance frequency is increased. In order to irradiate a laser beam to the resonance element, a slender slit 30 shown in FIG. 5 (*a*), which is defined along the longitudinal direction of the resonance element 5 and opened to the face of the resonance element, is formed through the dielectric 3*a* or 4*b* and through the ground conductor 6 covering the dielectric. Then, the laser beam 33 is irradiated to the resonance element through the slit 30 as shown in FIG. 5 (*b*) so as to finely trim the resonance element.

If too large an area of the resonance element is trimmed off, the resonance element itself may be cut in error, or the electromagnetic field may leak out of the ground conductor causing influences by external condition against the resonance frequency to increase. Therefore, the slit 30 is formed such that one side end of the slit is positioned at the longitudinal center line of the resonance element as shown in FIG. 6. Thus the resonance element never be trimmed off beyond a half of its width.

In order to reduce the outward leakage of the electromagnetic field, a width s of the slit 30 and a thickness b of the dielectric should be determined to satisfy the following equation.

$$s<b/2 \quad (3)$$

Several embodiments of the coupling means 7 will now be described with reference to FIGS. 7(*a*)–7(*d*).

In the embodiment shown in FIG. 7 (*a*), a coupling hole 7*a* is formed by removing the ground conductor partially at a position close to the wide section of the internal conductors 5 in the respective layers, and electromagnetically couples the two resonance elements 5. As the degree of coupling according to the coupling hole 7 is low, sufficient coupling when operating in a low frequency or in a wide frequency band cannot be expected.

In the embodiment shown in FIG. 7 (*b*), a conductive bar 7*b* which is perpendicular to the longitudinal direction of the resonance element 5 is formed as a coupling element at a position close to the wide part of the internal conductors 5 in the respective layers, and electromagnetically couples the two resonance elements 5.

In another embodiment shown in FIG. 7 (*c*), a coupling element 7*c* having a conductive bar and two conductive disks disposed at the both ends of the bar, with a diameter larger than that of the conductive bar is used. The disks are electrostatically coupled with the wide part of the internal conductors 5.

An even further embodiment shown in FIG. 7 (*d*) is an example for magnetically coupling the resonance elements. A hole is formed through the dielectric at a position near a top end of the narrow part of the resonance element 5, and then a conductive loop 7 (*d*), one end of the loop is coupled with the resonance element 5, and the other end of the loop is coupled with the ground conductor. In a modified example, both ends of the loop may be coupled with the ground conductors.

FIG. 8 shows a structure of a resonance element or an inner conductor 5. It is preferable that the resonance element 5 has an electrical resistance as small as possible so as to increase the Q value of the resonator. However, by a process of sintering after painting a conventional conductive paste on the dielectric, the electrical resistance of the resonance element cannot be reduced very much. Therefore, according to the present invention, a paste containing metallic silver in a scale shape, and a powder of alloy of silver and metal capable of being alloyed with silver (for example copper) is used as the conductive paste. The paste is first painted on an unsintered dielectric (for example, ceramics) substrate, and then both of the dielectric and the paste are sintered together. The sintering temperature is controlled at lower than a melting point of the silver but higher than a melting point of the alloy. As a result, the scale-shaped silver is not melted during the sintering and keeps the scale shape after sintering as shown by 52 in FIG. 8, whereas the alloy is melted. so that each element of the scale shaped silver 52 is brazed by the alloy 54. Thus, the resonance element is formed to have a structure in which the scale-shaped silver 52 is brazed by means of the alloy 54, so that its electrical resistance becomes a small value near the electrical resistance of silver itself.

One example of the composition of the conductive paste for the resonance element 5 is as follows:

| | |
|---|---|
| scale-shaped silver | 65 wt %–75 wt % |
| powder of silver-copper alloy | 16 wt %–6 wt % |
| glass frit | 4.5 wt % |
| organic binder | 3.6 wt % |
| organic solvent | 10.9 wt % |

A conventional paste containing silver-palladium powder may be used as a conductive paste for a ground conductor 6.

Finally, a producing process of a filter according to the present invention will be described. An unsintered ceramic sheet having a thickness of 160 μm which can be commercially obtained is first cut to a certain shape, and then the conductive paste is painted on the shaped sheet. Thereafter, the shaped sheets are piled as a stack with 14 layers, and then this stack is sintered at a temperature within 870° C.–940° C. so that a complete filter is obtained. Since the material may be shrunk by sintering the total thickness of the complete filter will be about 2 mm.

According to the above-mentioned process, a resonator having a Q higher than 200 can be obtained.

Industrial Applicability

As is described, a bandpass type filter formed with a small shape and the lowest electrical loss can be obtained according to the present invention. Such the filter may be utilized for an antenna duplexer in mobile communication.

We claim:

1. A bandpass type filter having a plurality of unit lamination structures in a piled structure, each of the plurality of unit lamination structures incorporates a first dielectric substrate provided with a bottom face to which a first ground conductor is attached, a circuit pattern face formed on a first top face of the first dielectric substrate, and a second dielectric substrate contacted to the first dielectric substrate via said circuit pattern face and provided with a second top face on which a second ground conductor is attached on, said circuit pattern face having at least one resonance element formed therein with one end of the resonance element grounded to said first and second ground conductors, said filter comprising:

a coupling means for electromagnetically coupling between two resonance elements disposed in different unit lamination structures, said means being formed in corresponding dielectric substrates between said two resonance elements;

each of the unit lamination structures having a separator for electromagnetically separating said at least one resonance element therein and first and second input/output terminals coupled with the circuit pattern face, said terminals being formed to couple with an external circuit.

2. A bandpass type filter as claimed in claim 1, wherein said separator has a plurality of conductive bars arranged at a predetermined interval, for short-circuiting the ground conductors of the first and second dielectric substrates.

3. A bandpass type filter as claimed in claim 2, wherein each resonance element includes a wide width section and a narrow width section, and said filter satisfies a following relationship:

$$\lambda_0/(2\sqrt{\epsilon}) > W > 5t$$

where W is the interval of the conductive bars, $\epsilon$ is a dielectric constant of the first and second dielectric substrates, $\lambda_0$ is a wave-length at the working frequency in a vacuum, and t is a width of the narrow width section of the resonance element.

4. A bandpass type filter as claimed in claim 2, wherein conductive electrodes for coupling said conductive bars with each other is formed in the circuit pattern face.

5. A bandpass type filter as claimed in claim 1, wherein said filter has a slit formed in one of the first and second dielectric substrates and defined open to the resonance element on the circuit pattern face, for trimming the resonance element by means of a light beam.

6. A bandpass type filter as claimed in claim 5, wherein said slit is a slender slit positioned along a longitudinal direction of the resonance element.

7. A bandpass type filter as claimed in claim 6, wherein said filter satisfies a following relationship:

$$s<b/2$$

where s is a width of said slit, and b is a thickness of the dielectric substrate in which the slit is defined.

8. A bandpass type filter as claimed in claim 7, wherein said slit is formed so that a side of the slit is positioned within a longitudinal center line of the resonance element.

9. A bandpass type filter as claimed in claim 1, wherein said coupling means is a hole formed in said corresponding dielectric substrates between said two resonance elements.

10. A bandpass type filter as claimed in claim 1, wherein said coupling means is a hole formed in said corresponding dielectric substrates, and a conductive bar inserted in said hole and positioned near said two resonance elements being coupled with each other.

11. A bandpass type filter as claimed in claim 10, wherein conductive disks which are parallel with a face of said two resonance elements are attached to both ends of said conductive bar.

12. A bandpass type filter is claimed in claim 1, wherein said coupling means is a hole formed in said corresponding dielectric substrates, and a conductive loop directly coupled with one of said two resonance elements and elongated to a position near the other of said two resonance elements, via said hole.

13. A bandpass type filter as claimed in claim 1, wherein each resonance element constitutes a sintered mixed paste formed on a dielectric substrate, the sintered mixed paste being formed from a metal powder having a melting point lower than that of silver mixed with a paste of scale shaped metallic silver.

14. A bandpass type filter as claimed in claim 1, wherein each resonance element with a length equal to or less than $\lambda/4$ has, along a longitudinal direction thereof, a narrow width section and a wide width section defined wider than the narrow width section, an end of the narrow width section being short-circuited to the ground conductors, and an end of the wide width section being electrically opened.

15. A bandpass type filter as claimed in claim 14, wherein the narrow width section of said each resonance element is divided in a comb shape and is coupled to the wide width section.

16. A bandpass type filter as claimed in claim 1, wherein one ground conductor of each adjacent unit lamination structure is commonly disposed therebetween.

17. A bandpass type filter as claimed in claim 1, wherein a heat radiator is coupled to one of the ground conductors of one of the unit lamination structures.

18. A bandpass type filter, comprising:

a plurality of unit lamination structures in a piled structure, each of the plurality of unit lamination structures including a first dielectric substrate provided with a bottom face on which a first ground conductor is formed, a second dielectric substrate having a second bottom face contacting a first top face of the first dielectric substrate and a second top face on which a second ground conductor is attached, and a circuit pattern formed between the first top face of the first dielectric substrate and the second bottom face of the second dielectric substrate, wherein the circuit pattern has a plurality of resonance elements formed therein at predetermined intervals with one end of each of the resonance elements grounded to said first and second ground conductors;

a coupling means for electromagnetically coupling between two resonance elements each located in a different unit lamination structure, said means being formed in corresponding dielectric substrates between the two resonance elements to be coupled;

each of the unit lamination structures having a separator means for electromagnetically separating said plurality of resonance elements therein; and first and second input/output terminals coupled with the circuit pattern, said terminals being formed to couple with an external circuit.

19. A bandpass type filter as claimed in claim 18, wherein said separator has a plurality of conductive bars arranged at predetermined intervals, for short-circuiting the ground conductors of the first and second dielectric substrates.

20. A bandpass type filter as claimed in claim 19, wherein each of the resonance elements includes a capacitance section and an inductance section, wherein the capacitance section is defined to have a width greater than a width of the inductance section and said filter satisfies the relationship:

$$\lambda_0/(2\sqrt{\epsilon}) > W > 5t$$

where W is the interval of the conductive bars, $\epsilon$ is a dielectric constant of the first and second dielectric substrates, $\lambda_0$ is a wave-length at a working frequency in a vacuum, and t is a width of the inductance section of a resonance element.

21. A bandpass type filter as claimed in claim 19, wherein conductive electrodes for coupling said conductive bars with each other is formed in the circuit pattern.

22. A bandpass type filter as claimed in claim 18, wherein said filter has a slit defined in one of the first and second dielectric substrates and defined open to a resonance element on the circuit pattern, for trimming the inductance section of the resonance element.

23. A bandpass type filter as claimed in claim 22, wherein said slit is positioned along a longitudinal direction of the resonance element.

24. A bandpass type filter as claimed in claim 23, wherein said filter satisfies the relationship:

$$s<b/2$$

where s is a width of the slit, and b is a thickness of the dielectric substrate in which the slit is defined.

25. A bandpass type filter as claimed in claim 24, wherein said slit is formed so that a side of the slit is positioned within a longitudinal centerline of the resonance element.

26. A bandpass type filter as claimed in claim 18, wherein said coupling means includes a hole defined in said corresponding dielectric substrates between the two resonance elements.

27. A bandpass type filter as claimed in claim 18, wherein said coupling means is a hole defined in said corresponding dielectric substrates, and a conductive bar inserted in said hole and positioned near the two resonance elements being coupled with each other.

28. A bandpass type filter as claimed in claim 27, wherein conductive disks which are parallel with faces of the two resonance elements are attached to both ends of said conductive bar.

29. A bandpass type filter as claimed in claim 18, wherein said coupling means is a hole defined in said corresponding dielectric substrates, and a conductive loop directly coupled with one of the two resonance elements and extending to a position near the other of the two resonance elements through the hole.

30. A bandpass type filter as claimed in claim 18, wherein each of the resonance elements constitutes a sintered mixed paste formed on a dielectric substrate, the sintered mixed paste being formed from a metal powder having a melting point lower than that of silver mixed with a paste of scale shaped metallic silver.

31. A bandpass type filter as claimed in claim 18, wherein each of the resonance elements with a length equal to or less than $\lambda/4$ has along a longitudinal direction thereof, an inductance section and a capacitance section defined to have a width greater than a width of the inductance section, an end of the inductance section being short-circuited to the ground conductors, and an end of the capacitance section being electrically open.

32. A bandpass type filter as claimed in claim 31, wherein the inductance section of each of the resonance elements is divided into a comb shape and is coupled to the capacitance section.

33. A bandpass type filter as claimed in claim 18, wherein one ground conductor of each adjacent unit lamination structure is commonly disposed therebetween.

34. A bandpass type filter as claimed in claim 18, wherein a heat radiator is coupled to one of the ground conductors of one of the unit lamination structures.

* * * * *